US008271274B2

(12) United States Patent
Massaloux et al.

(10) Patent No.: US 8,271,274 B2
(45) Date of Patent: Sep. 18, 2012

(54) CODING/DECODING OF A DIGITAL AUDIO SIGNAL, IN CELP TECHNIQUE

(75) Inventors: Dominique Massaloux, Perros-Guirec (FR); Romain Trilling, Marnes la Coquette (FR); Claude Lamblin, Perros-Guirec (FR)

(73) Assignee: France Telecom, Paris (FR)

( * ) Notice: Subject to any disclaimer, the term of this patent is extended or adjusted under 35 U.S.C. 154(b) by 971 days.

(21) Appl. No.: 12/224,205

(22) PCT Filed: Feb. 13, 2007

(86) PCT No.: PCT/FR2007/050780
§ 371 (c)(1),
(2), (4) Date: Nov. 21, 2008

(87) PCT Pub. No.: WO2007/096550
PCT Pub. Date: Aug. 30, 2007

(65) Prior Publication Data

US 2009/0222273 A1 Sep. 3, 2009

(30) Foreign Application Priority Data

Feb. 22, 2006 (FR) ..... 06 01563

(51) Int. Cl.
*G10L 21/00* (2006.01)

(52) U.S. Cl. .... 704/219; 704/223; 704/500; 375/240.22

(58) Field of Classification Search ..... 704/219, 704/223, 500; 375/240.22
See application file for complete search history.

(56) References Cited

U.S. PATENT DOCUMENTS

| | | | | |
|---|---|---|---|---|
| 5,327,519 | A * | 7/1994 | Haggvist et al. | 704/219 |
| 6,449,313 | B1 * | 9/2002 | Erzin et al. | 375/259 |
| 6,928,406 | B1 * | 8/2005 | Ehara et al. | 704/223 |
| 2002/0138256 | A1 | 9/2002 | Thyssen | |

FOREIGN PATENT DOCUMENTS

EP 0 967 594 A1 12/1999

OTHER PUBLICATIONS

Atal B.S. et al.; "Code-Excited Linear Production (CELP): High Quality Speech at Very Slow Bit Rates"; ICASSP, 1985, pp. 937-940.

(Continued)

*Primary Examiner* — Daniel D Abebe
(74) *Attorney, Agent, or Firm* — McKenna Long & Aldridge LLP

(57) ABSTRACT

The invention aims at constructing improved dictionaries of CELP excitation vectors for coding/decoding digital audio signals. Usually, each vector of dimension N comprises pulses capable of occupying N valid positions. The invention concerns the construction of dictionaries with particular structure by: providing a common sequence of pulses forming a base pattern; and assigning the base pattern to each excitation vector of the dictionary, based on one or more occurrences at one or more respective positions among said N valid positions. The invention also concerns a combination of dictionaries thus constructed with optionally standard multi-pulse dictionaries, by union or summation or cascading.

14 Claims, 8 Drawing Sheets

OTHER PUBLICATIONS

Figure 1:
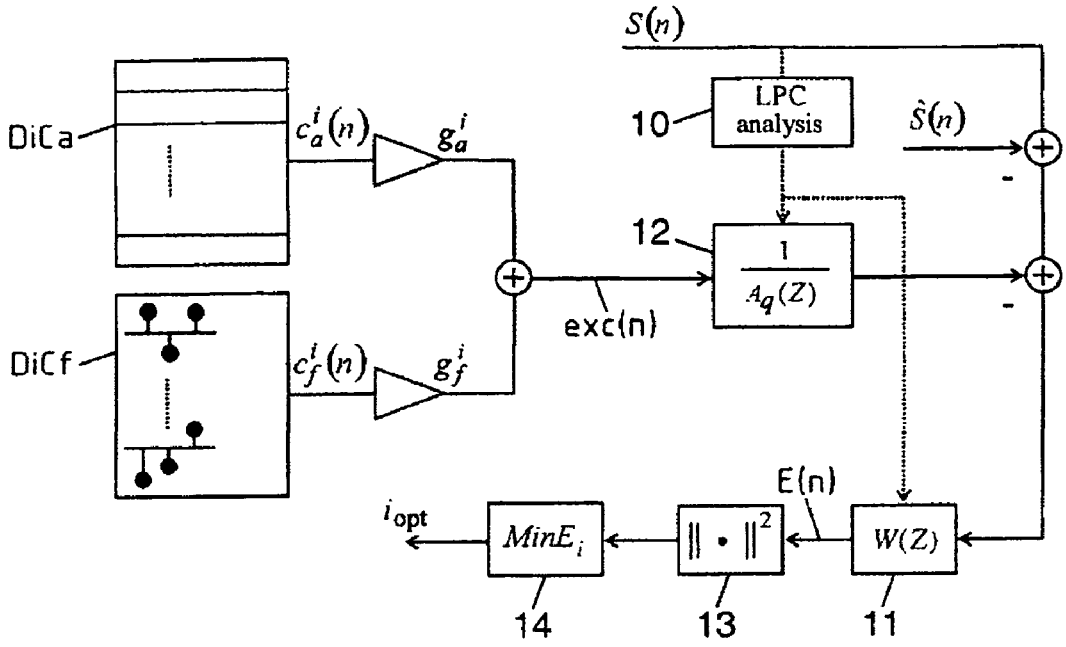

Ehara et al.; "A high quality 4-kbit/s speed coding algorithm based on MDP-CELP" VTC 2000-Spring. 2000 IEEE 51st. Vehicular Technology Conf. Proceedings, Tokyo, Japan, May 15-18, 2000—IEEE Vehicular Technology Conf. New-York: IEEE US- vol. 2 of 3, conf. 51, pp. 1572-1576, XP000968135—ISBN 0-7803-5719-1, Abstract, figure 3, alinea [00IV].

Yasunaga K. et al.; "Dispersed-pulse codebook and its application to a 4 KB/S speech coder"—Acoustics, speech, and signal process, 2000.ICASSP'00.Proc. 2000 IEEE Intern.Cont on Jun. 5-9, 2000, Piscataway, NJ, USA, IEEE, vol. 3 (Jun. 5, 2006), pp. 1503-1506, XP010507636, ISBN 0-7803-6293-4.

* cited by examiner

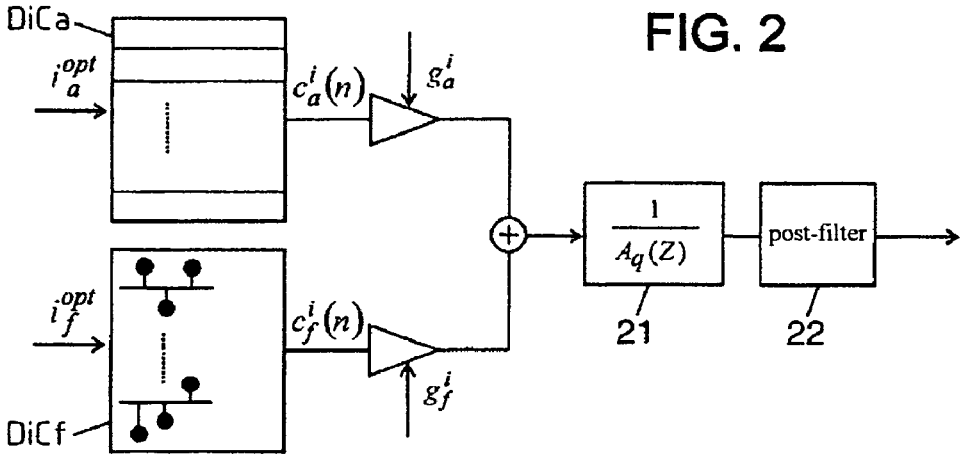
FIG. 2
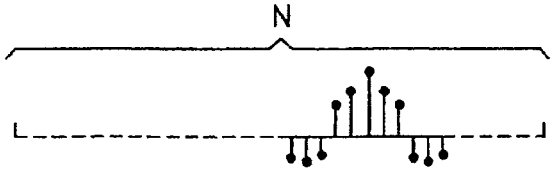
FIG. 3a
FIG. 3b
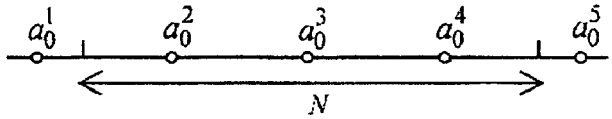
FIG. 3c
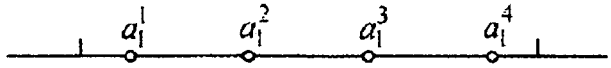
FIG. 3d
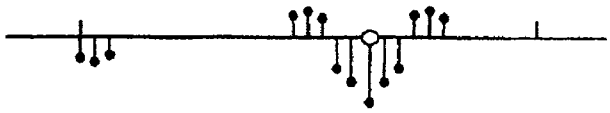

| | | CONDITIONS |
|---|---|---|
| $\phi'(a_k,a_k)=$ | $\phi(a_k,a_k)+\sum_{n=0}^{N-1}H'(n,a_k)^2-2\sum_{n=0}^{N-1}H'(n,a_k)\times H(n-a_k)$ | $a_k\in\Gamma_g$ |
| | $\phi(a_k,a_k)+\sum_{n=0}^{N-1}H''(n,a_k)^2-2\sum_{n=0}^{N-1}H''(n,a_k)\times H(n-a_k)$ | $a_k\in\Gamma_d$ |
| | $\phi(a_k,a_k)$ | $a_k\notin(\Gamma_g\cup\Gamma_d)$ |
| $\phi'(a_k,a_l)=$ $k<l$ | $\phi(a_k,a_l)+\sum_{n=0}^{N-1}H'(n,a_k)\times H'(n,a_l)-\sum_{n=0}^{N-1}H'(n,a_k)\times H(n-a_l)-\sum_{n=0}^{N-1}H'(n,a_l)\times H(n-a_k)$ | $a_k\in\Gamma_g$ ; $a_l\in\Gamma_g$ |
| | $\phi(a_k,a_l)-\sum_{n=0}^{N-1}H'(n,a_k)\times H(n-a_l)-\sum_{n=0}^{N-1}H(n-a_k)\times H''(n,a_l)+\sum_{n=0}^{N-1}H'(n,a_k)\times H''(n,a_l)$ | $a_k\in\Gamma_g$ ; $a_l\in\Gamma_d$ |
| | $\phi(a_k,a_l)-\sum_{n=0}^{N-1}H'(n,a_l)\times H(n-a_k)-\sum_{n=0}^{N-1}H(n-a_l)\times H''(n,a_k)+\sum_{n=0}^{N-1}H'(n,a_l)\times H''(n,a_k)$ | $a_k\in\Gamma_d$ ; $a_l\in\Gamma_g$ |
| | $\phi(a_k,a_l)-\sum_{n=0}^{N-1}H'(n,a_k)\times H(n-a_l)$ | $a_k\in\Gamma_g$ ; $a_l\notin(\Gamma_g\cup\Gamma_d)$ |
| | $\phi(a_k,a_l)-\sum_{n=0}^{N-1}H''(n,a_l)\times H(n-a_k)$ | $a_k\notin(\Gamma_g\cup\Gamma_d)$; $a_l\in\Gamma_g$ |
| | $\phi(a_k,a_l)+\sum_{n=0}^{N-1}H''(n,a_k)\times H''(n,a_l)-\sum_{n=0}^{N-1}H''(n,a_k)\times H(n-a_l)-\sum_{n=0}^{N-1}H''(n,a_l)\times H(n-a_k)$ | $a_k\in\Gamma_d$ ; $a_l\in\Gamma_d$ |
| | $\phi(a_k,a_l)-\sum_{n=0}^{N-1}H(n-a_k)\times H''(n,a_l)$ | $a_k\notin(\Gamma_g\cup\Gamma_d)$; $a_l\in\Gamma_d$ |
| | $\phi(a_k,a_l)-\sum_{n=0}^{N-1}H(n-a_l)\times H''(n,a_k)$ | $a_k\in\Gamma_d$ ; $a_l\notin(\Gamma_g\cup\Gamma_d)$ |
| | $\phi(a_k,a_l)$ | $a_k$ ; $a_l\notin(\Gamma_g\cup\Gamma_d)$ |

FIG. 4

CODING/DECODING OF A DIGITAL AUDIO SIGNAL, IN CELP TECHNIQUE

The present invention relates to the coding/decoding of digital audio signals, using the "CELP" (Code Excited Linear Prediction) technique.

Compression-mode encoding of such signals can be required for their transmission or their storage. The signals can be speech signals or, more generally, digitized sound signals. More specifically, this invention relates to the predictive encoding technique in which:

- a short-term prediction of an input signal is first performed to estimate a synthesis filter (called "LPC" filter, LPC standing for "Linear Prediction Coding"),
- then the residual signal obtained by filtering of the original signal by the LPC filter is modeled (by a so-called "excitation" signal which uses filtering to produce the reconstructed signal) and coded.

More specifically, the invention relates to the family of CELP (Code Excited Linear Prediction) coders, which select the excitation signal from a set of candidate signals by comparing the output of the synthesis filter, excited by this signal, to the original signal, with the introduction of a perceptual weighting. Such coders have been widely employed for the coding of speech signals in 6 to 24 Kbit/s bit rates, and notably adopted in the ITU-T G.729, GSM-EFR, 3GPP/WB-AMR standards.

The invention is advantageously applicable in hierarchical coding systems described in detail hereinbelow and for which the bitstream is formed by a basic layer followed by supplementary layers for enhancing the quality.

STATE OF THE PRIOR ART

A general diagram of a CELP coder is given in FIG. 1. FIG. 2 presents the associated decoder.

Details regarding this type of coder/decoder are given in particular in a basic reference:
"*Code-Excited Linear Production (CELP): High Quality Speech at Very Low Bit Rates*", B. S. Atal and M. R. Schroeder, ICASSP, 1985, pp. 937-940.

Referring to FIG. 1, the coder segments an input signal S(n) into sample blocks or "frames" (typically of the order of 10 to 20 ms of signal). Then, an LPC analysis 10 is performed to estimate and quantize the parameters of the short-term linear prediction filter. In most cases, the modeling of the excitation signal exc(z) is then performed using two codebooks:

- the adaptive codebook DICa intended to model the periodicity of the harmonic sounds, and
- the so-called "fixed" codebook DICf for the non-harmonic part and the non-voiced sounds.

The present invention is aimed more at the "fixed" codebook DICf, while what relates to the adaptive codebook DICa is preferably not dealt with below.

The modeling of the excitation signal is generally performed on sample blocks corresponding to signal sub-frames typically of the order of 5 ms. Hereinafter, the case will be considered of a signal sub-frame comprising N samples (for example N=40 samples at 8 kHz sampling frequency). In such a coder, the selection of an optimum code word in a codebook (also called "vector code" or "waveform") is performed by minimizing the energy of the perceptually-weighted error signal, which is expressed by a relation of the type: $E(z)=W(z)(S(z)-\tilde{S}(z))$, in which the notations E(z), S(z), $\tilde{S}(z)$ represent the z transforms, respectively, of the weighted error signal, of the original signal to be coded and of the reconstructed signal.

The filter W(z) is the perceptual weighting filter 11 (conventionally of the type $$\frac{A(z/\gamma_1)}{A(z/\gamma_2)},$$

A(z) designating the LPC analysis filter, and the factors $\gamma_1$ and $\gamma_2$ adjust the degree of perceptual weighting).

The weighted error signal E(z) can be expressed by a relation of the type:

$$E(z) = \frac{W(z)}{A_q(z)}(res(z) - exc(z)),$$

$1/A_q(z)$ corresponds to the LPC synthesis filter 12,
res(z) is the LPC residual signal,
exc(z) is the excitation signal defined by:

$$exc(n) = \begin{cases} exc_{past}(n) & \text{if } n < 0 \\ exc_{current}(n) = g \times c(n) & \text{if } 0 \le n \le N-1 \end{cases}$$

The signals $exc_{past}(n)$ and $exc_{current}(n)$ respectively represent the passed excitation signal (zero signal on the current block) and current excitation signal (zero-memory signal).

Thus, appropriate respective gains $g=g_a^i$ and $g=g_f^i$ are applied to the signals $c(n)=c_a^i(n)$ and $c(n)=c_f^i(n)$ at the output of the adaptive codebook DICa and fixed codebook DICf. Then, these signals are added together to obtain the excitation signal exc(n).

More particularly, in the example of FIG. 1, the signal $\hat{S}(n)$ is defined, for which the z transform, $\hat{S}(z)$, represents the prediction of the past excitation according to a relation of the type:

$$\hat{S}(z) = \frac{exc_{past}(z)}{A_q(z)}$$

Also conventionally defined are the compound filter:

$$H(z) = \frac{W(z)}{A_q(z)} \tag{1}$$

and the "filtered target signal" by a relation of the type:

$$x(z)=H(z)(res(z)-exc_{past}(z)).$$

Devolving from these relations, for the weighted error signal, is an expression of the type:

$$E(z)=x(z)-H(z)\times exc_{current}(z).$$

The CELP minimization criterion (subsequent modules 13 and 14) is then expressed by a search in a codebook for the waveform $\{c(n); 0 \leqq n \leqq N-1\}$ which minimizes the quantity:

$$E = \sum_{n=0}^{N-1} (x(n) - g \times c^w(n))^2,$$

-continued $$\frac{Num^2}{Den} = \frac{\left(\sum_{n=0}^{N-1} x(n)c^w(n)\right)^2}{\sum_{n=0}^{N-i} c^w(n)^2},$$

or even, which minimizes the ratio with $$c^w(n) = h(n) * c(n)$$

$$= \sum_{i=-\infty}^{+\infty} h(i) \times c(n-i)$$

The elements {h(n)} represent the impulse response of the filter H (defined hereinabove by the above relation (1)).

It is generally considered that the filter H is causal, that is, the elements h(n) such that n<0 are zero. However, hereinafter, the more general case will be assumed in which all or some of the elements h(n) such that n<0 can be non-zero.

Conventionally, the so-called backward filtering technique explained in:

"*Fast CELP coding based on algebraic codes*", J. P. Adoul, P. Mabilleau, M. Delprat, S. Morissette, ICASSP 1987, pp. 1957-1960, can be used to precalculate elements common to all the vectors (in particular the intercorrelation between the target vector and the filter H(z)) for the numerator, by:

$$Num = \sum_{k=0}^{N-1} c(k) \times d(k)$$

with $$d(k) = \sum_{n=k}^{N-1} x(n) \times h(n-k);$$

for k ranging from 0 to N−1.

Similarly, it is possible to calculate the self-correlation of the filter H(z) prior to the search in the codebook, and to use it to speed up the calculations of the denominator, with:

$$Den = \sum_{k=0}^{N-1} c(k)^2 \times \phi(k, k) + 2\sum_{k=0}^{N-2} \sum_{k'=k+1}^{N-1} c(k) \times c(k') \times \phi(k, k'),$$

in which:

$$\phi(k, k') = \sum_{n=0}^{N-1} h(n-k) \times h(n-k'),$$

for k and k' ranging from 0 to N−1.

The optimum gain associated with the selected vector code is quantized. A quantization index and the index associated with the selected vector code are transmitted (via a telecommunication network) or simply stored for a subsequent transmission. The decoding can then take place on the basis of these indices.

In the decoding, referring to FIG. 2, the respective gains $g_a^i$, $g_f^i$ are decoded and the indices $i_a^{opt}$, $i_f^{opt}$ of the respectively selected vector codes can be used to retrieve their component elements, to reconstruct the excitation signal, then the reconstructed signal (subsequent modules 21 and 22).

The choice of the excitation codebook is guided by constraints of bit rate, quality (or efficiency for a given bit rate) and complexity. For a restricted bit rate, it will be difficult to obtain a good reproduction quality for any signal to be coded. The complexity is also an important factor. For all the communication applications, the real time constraint imposes limitations on the calculation time. The first CELP codebooks proposed in the literature were formed by randomly-drawn vector codes, which impose calculating the numerator and the denominator of the criterion for each vector of the codebook. The search for the best code word was then prohibitively complex.

Structured codebooks were then proposed to speed up the search for the optimum waveform, certain search calculations being performed once for different input signals (or "common calculations") using the relations induced between the vectors by the structure of the codebook. One of the most popular categories of structured codebooks is the family of algebraic codebooks, made up of pulses whose position is defined by an algebraic code or even according to an array of points (typically a Gosset array), regular or not. The most conventional representatives of such codebooks are known by the name ACELP (for "Algebraic CELP"). These structured codebooks make it possible to avoid the storage of the code words, a bijective relation that makes it possible to calculate the elements of the vector codes from their index.

Moreover, these codebooks have given rise to rapid searches accelerated by sub-optimal but very effective focused exploration algorithms. Thus, for a multi-pulse codebook, the expressions of the numerator and denominator defined hereinabove are simplified if it is assumed that the vectors of such a codebook are made up of K pulses, of amplitudes $s_k$ with k between 0 and K−1 (these amplitudes in practise often being reduced to a simple sign), with:

$$Num = \sum_{k=0}^{K-1} s_k \times d(a_k)$$

and $$Den = \sum_{k=0}^{K-1} s_k^2 \times \phi(a_k, a_k) + 2 \times \sum_{k=0}^{K-2} \sum_{l=1}^{K-1} s_k \times s_l \times \phi(a_k, a_l),$$

where $a_k$ and $a_l$ represent the positions at which the pulses appear.

However, these codebooks, when the bit rate constraint limits their size, present the drawback of a certain lack of richness in content. The pulses become fewer, and, because of this, very sparse. The term "Sparse Codebooks" then applies. All the non-zero samples have the same amplitude and it is difficult to correctly represent the balance in amplitude between the samples of the block with very few pulses. The degradations induced by the use of excessively poor algebraic codebooks are then very audible. They are characterized, for example, by a certain raucousness of the signal.

To overcome these drawbacks, the so-called "sparseness reduction" technique was proposed in U.S. Pat. No. 6,029,125. It proposes enriching a multi-pulse codebook comprising a small number of pulses (and therefore presenting a certain "sparseness") either by addition with a noise signal, or by filtering using an all-pass filter, which disperses the pulses without modifying the modulus of the spectrum of the signal. Such a filtering acts mainly on the phase. These modifications of the codebook can be introduced after the decoding or can be introduced in the selection process (therefore in the coding).

However, when it is introduced into the coder, the addition of noise hampers the use of rapid algorithms for selecting the optimum waveform. Moreover, the filtering of the fixed codebook presupposes a certain continuity of the process because the filters tend to spread the support of the filtered signal, and, since it is generally not possible to correct the excitation of the preceding block, irregularities at the edge of the coded sample blocks, badly controlled by the process, can appear.

Furthermore, if there is a desire to adapt the type of modification made to the codebook according to the signal, there are no other solutions than to provide different filters that switch from filters to others, which can also generate distortions.

Moreover, as indicated already hereinabove, the technique presented in this document U.S. Pat. No. 6,029,125 seeks to remedy the lack of pulses of a codebook by applying a modification that retains the spectral appearance of the codebook. Now, it is often necessary to enrich the multi-pulse codebooks, by including vector codes that better encode certain parts of the spectrum, in particular the high frequencies, which is incompatible with the solution retained in U.S. Pat. No. 6,029,125.

Other types of codebooks have been proposed to increase performance by maintaining acceptable search complexities. Thus, the cascaded codebooks (or "multi-stage" codebooks), possibly different, give rise to multiple successive CELP searches, each search producing the index of a selected vector code with its associated gain.

The excitation vector is then expressed by:

$$exc_{current}(n) = \sum_{i=0}^{I-1} g_i \times c_i(n);\ 0 \le n \le N-1,$$

if it is assumed that a number I of codebooks is cascaded.

The joint search for the code sub-vectors $\{c_i(n)\}$ in the I codebooks can be complex. In practise, a sub-optimal serial search method is used and consists in selecting the optimum waveform in the first codebook and calculating the associated gain, then in quantizing this gain and subtracting the known contribution of this first codebook, which, re-using the expressions given above, is translated by:

$$E(z) = \frac{W(z)}{A_q(z)}(res(z) - exc_1(z) - exc_2(n)),$$

with $$exc_1(n) = \begin{cases} exc_{past}(n) & \text{if } n < 0 \\ g_1 xc_1(n) & \text{if } 0 \le n \le N-1 \end{cases}$$

$$\text{and } exc_2(n) = \begin{cases} 0 & \text{if } n < 0 \\ g_2 \times c_2(n) & \text{if } 0 \le n \le N-1 \end{cases}$$

The "filtered target signal" is modified to $x'(z)=H(z)(res(z)-exc_1(z))$ and the selection of the subvector of the second codebook is thus made. The process is then repeated for all the successive codebooks.

It should be noted that the use of orthogonal codebooks can also be provided for in this context.

There now follows a brief description of the hierarchical coding structures.

Such structures, also called "scalable", supply the coding process with binary data that is divided into successive layers. A base layer is formed by the bits that are absolutely necessary to the decoding of the bitstream, and determine a minimum decoding quality. The subsequent layers make it possible to progressively enhance the quality of the decoded signal, each new layer adding new information which, used in the decoding, supplies as output a signal of increasing quality. One of the particular features of the hierarchical coders is the possibility of intervening at any level of the transmission or storage chain to delete a portion of the bitstream without having to provide any particular indication to the coder or to the decoder. The decoder uses the binary information that it receives and produces a signal of corresponding quality.

The composition of the hierarchical coding processing operations includes the concept of coding "layers". These layers can be constructed by implementing methods deriving from different techniques. As a variant, the different coding layers can be derived from one and the same type of processing, in which it is possible to enhance the quality simply by providing supplementary data. Thus, the hierarchical CELP coders, also called "nested CELP" coders, generally use several codebooks, which can be different at each stage, or identical.

Nevertheless, the cascaded codebooks and the codebooks involved in the hierarchical coding structures still present the same problems as those described previously.

The present invention seeks to improve the situation.

In particular, it aims to remedy the lack of richness, in terms of waveforms and spectral content, of the CELP codebooks at low bit rates, while retaining the very simple decoding and the low complexity associated with these codebooks. It also offers a progressive enrichment of the codebooks, which is of particular interest in the context of the hierarchical coding structures. Another object is to propose an attractive alternative to the so-called "anti-sparseness" techniques and, more generally, to contribute to the enrichment of the sparse codebooks, with a better control of the continuity between successive blocks.

To this end, it proposes a method of constructing a codebook of CELP-type excitation vectors for coding/decoding digital audio signals, each vector of dimension N comprising pulses that can occupy N valid positions.

In the inventive method, an initial codebook (also called "base codebook") is constructed by:

- providing a common sequence of pulses forming a basic pattern,
- and assigning the basic pattern to each excitation vector of the codebook, based on one or more occurrences at one or more respective positions out of said N valid positions.

The expression "sequence of pulses" should be understood here to mean a succession of samples comprising pulses and, where appropriate, one or more zero-samples between the pulses, and/or at the start and/or at the end of the succession.

Preferably, the duly constructed codebook is a CELP excitation codebook of the so-called "fixed" type (referenced DICf for example in FIGS. 1 and 2 described hereinabove).

Preferably, the basic pattern appearing on each occurrence in an excitation vector is multiplied by an amplitude associated with said occurrence, this amplitude being, for example, chosen from a set comprising the values +1 and −1.

Preferably again, all the vectors of the initial codebook comprise one and the same number of occurrences of the basic pattern.

Thus, an initial codebook can be defined by:

the sequence of pulses forming the basic pattern, the number of occurrences of the pattern in each vector, sets of positions allowed for the occurrences of said patterns, and sets of amplitudes to be associated with the occurrences of said patterns.

The invention thus proposes constructing codebooks of CELP excitation vectors, these codebooks being defined by the data of a basic pattern, appearing in one or more occurrences, each occurrence being multiplied by an amplitude. The patterns possibly appearing at the block edge (sample frames or sub-frames) are truncated to be inserted exactly in the block.

In more generic terms, it will be understood that the patterns appearing at the block edge of a vector are truncated and the remaining pulses of the truncated patterns occupy the start or the end of the block.

A codebook obtained by the inventive method, gathering together the vectors of dimension N, is then defined by a basic pattern, that is "shifted" in the block of length N. Each pattern appears in K occurrences that are added together, each occurrence being itself defined by:

an amplitude term (possibly polarity) that is, the pattern is multiplied by a given value (for example ±1) for each occurrence, and the position of the pattern in the occurrence.

It will be noted however that a multi-pulse codebook, well known in the state of the art, constitutes a particular case of a codebook obtained in this way, in as much as the length of a pattern in the case of a multi-pulse codebook is simply 1. This type of multi-pulse codebook will be designated hereinafter "trivial base codebook".

Moreover, the inventive method makes it possible to construct combinations of codebooks (initial and constructed, as described hereinabove, without excluding also the use of one or more supplementary conventional multi-pulse codebooks).

Thus, a codebook obtained by the inventive method can consist of:

a single base codebook, non-trivial, defined by a basic pattern (of length greater than 1), by the positions of the pattern and by the associated amplitude according to the different occurrences, or a union of base codebooks, in which at least one of the base codebooks is a non-trivial base codebook, or a summation of base codebooks, possibly weighted, in which at least one of the base codebooks is a non-trivial base codebook, the occurrences of all the patterns being summed together.

In more generic terms, a global codebook can be constructed by a summation of base codebooks, at least one of which is an initial codebook defined by a basic pattern. The vectors of the global codebook are formed in this case by adding together the common position pulses of the vectors of the base codebooks, preferably weighted one by one by a gain each associated with a codebook.

As a variant, a global codebook can be constructed by a union of base codebooks, at least one of which is an initial codebook defined by a basic pattern. In this case, the global codebook simply comprises all the vectors of all the base codebooks.

The construction of such codebooks already makes it possible to provide a variety of content types. Depending on the form of the basic patterns and their number of occurrences, it will be possible to obtain excitation vectors of varying appearances, possibly having a relatively high number of non-zero pulses. For example, the choice of the basic pattern can be guided by spectral-type considerations. This richness of content does not necessarily require a particularly large codebook size because, by adding together the occurrences of the patterns, it is possible to vary the forms of the excitation vectors with a moderate number of patterns and occurrences. Thus, it is possible to represent excitation vectors that have a spectral content substantially different from that of the conventional multi-pulse codebooks, for sets of equivalent indices.

In such an embodiment, it is possible to provide for the basic pattern to comprise at least one central pulse, preceded and succeeded by at least one pulse of sign opposite to the sign of the central pulse. More specifically, the pattern can comprise in total three pulses, namely:

a central pulse, a second pulse preceding the central pulse, and a third pulse succeeding the central pulse, the signs of the second and third pulses being opposite to that of the central pulse, the amplitude of the second and third pulses being less, as an absolute value, than that of the central pulse and, advantageously, variable between 0 (not inclusive) and approximately half the amplitude of the central pulse, as an absolute value.

It then proved advantageous to provide a coding/decoding device comprising a cascading of codebooks, of which at least one initial codebook is subsequent in the cascade, this initial codebook comprising such a symmetrical pattern with central pulse and preceding and subsequent pulses of amplitudes opposite to that of the central pulse. This device can advantageously comprise a high-pass filtering in a global perceptual weighting filter involved in particular in the coding in the search for an optimum excitation vector. One example of such an embodiment will be described in detail below, with reference to FIGS. 8*a*, 8*b*, 8*c* and 9. This embodiment made it possible to focus the search in the initial codebook by the use of a high-pass filter.

It is stated simply here that this embodiment proposes a cascading of a multi-pulse codebook with a codebook defined by a pattern that is symmetrical in relation to its center, of which the occurrences of the center of the pattern describe the same set as the occurrences of the pulses of the multi-pulse codebook.

This implementation makes it possible to widen the spectral domain of the initial base codebook by the addition of one or more supplementary base codebooks, the search in these supplementary base codebooks then being focused spectrally by modifying the perceptual weighting filter involved in the search for the optimum vector, the choice of this modification and that of the pattern of these supplementary base codebooks possibly being linked.

More generally, in the case of a union or summation of several base codebooks, base codebooks are used for which the centers of the patterns and the associated amplitudes describe the same sets but for different patterns.

Thus, more generically, the positions of the patterns and/or of the pulses in the vectors of the codebooks, particularly when they are cascaded, describe sets that are preferably identical, the position of a pattern being identified substantially by the position of a central pulse in the sequence of pulses forming the pattern.

It is then possible to share the calculations and the rapid processing algorithms because the techniques for searching for a best candidate excitation vector remain rapid in the codebooks constructed in accordance with the invention, since the latter use the particular structure of the conventional multi-pulse codebooks, and make it possible to use effective processing operations put in place for the case of the multi-pulse codebooks.

It is indicated here that the position of a pattern can be identified by the position in the block of the sample of the center of the pattern, if the pattern comprises an odd number of samples. However, in a strictly equivalent manner, any pattern of even length can be complemented by a zero in order to produce an odd length. More generally, any other variant for identifying the position the of patterns can be envisaged.

The invention proposes very simple techniques for decoding the index of the vectors of such codebooks, by adding together the scaled occurrences of the pattern or patterns of which the position and the amplitude factor for each occurrence are transmitted.

In generic terms, in the coding, after determining a best candidate vector in an initial codebook, an index is formed that preferably comprises at least indications:

- of the position or positions of the basic pattern in the best candidate vector, and
- of the amplitude or amplitudes associated with the position or positions of the pattern, said index being intended to be transmitted for a subsequent decoding.

If a plurality of codebooks are provided, the index also comprises an indication of the codebook in which the best candidate vector has been found. Thus, if the best candidate vector has been found in an initial codebook comprising a basic pattern, the index comprises in particular an indication relating to the abovementioned initial codebook and, from this, an indication as to the basic pattern that made it possible to construct the codebook and therefore the best candidate vector.

In the case of a single base codebook, the index already reflects the amplitude and the position associated with each of its occurrences. To decode the best candidate vector, it is then sufficient to position the basic pattern at the different positions that it must occupy in each occurrence, multiply it by the associated amplitudes, and calculate the sum of the occurrences.

In the case of a union of base codebooks, the index also gives information on the selected base codebook, as indicated previously.

In the case of a summation of base codebooks, amplitudes and positions are available for the occurrences of each basic pattern, and the procedure is then equivalent to the union case, that this time summing the contributions of all the patterns.

The decoding of the indices of the vectors of a codebook according to the invention is very simple.

In the decoding, the best candidate vector is preferably reconstructed from the index:

- possibly in the case of a use of a union of codebooks, by already determining the basic pattern corresponding to the initial codebook indicated by the index,
- by positioning the basic pattern at the positions indicated by the index,
- by multiplying the pattern at each position by an associated amplitude indicated by the index,
- and by adding together the multiplied patterns positioned at said indicated positions.

In the case of a use of a sum of codebooks, the indices of the vectors in each of the codebooks are preferably determined and, from this, the last three steps described hereinabove are applied for each index.

It is possible to speed up the search in the codebooks according to the invention and there appeared to be a particular interest in providing the sets of the positions of the patterns with a strong structure, for example that of the ACELP codebooks, to adapt the very effective rapid search processing operations usually put in place in the ACELP codebooks.

Thus, in more generic terms, the codebook constructed according to the invention preferably comprises accepted pattern positions that describe a strongly structured set, advantageously as a set of positions of pulses of an ACELP codebook.

As indicated hereinabove, in the case of the use of a plurality of codebooks, there is particular interest in providing two or more base codebooks with identical sets of pattern positions, to be able to reuse the same processing operations in the search in the codebooks. Thus, at least one of these codebooks can advantageously be of ACELP type.

The cascading of codebooks including at least one base codebook is very advantageous. This variant is particularly suited to the case of hierarchical coding structures. Nevertheless, the various base codebooks do not serve the same purpose because, typically, the first codebook handles the coding of a minimum quality of the signals that it is desirable to reproduce. The subsequent codebooks are intended more to improve this quality, and will make it possible to consolidate the coding, reduce the sensitivity to the signal type, or address some other factor.

In more generic terms, the cascading of a plurality of codebooks amounts to constructing a single global codebook obtained by summation of the gain-weighted codebooks, as indicated hereinabove.

In this case, each excitation vector corresponds to the sum of vectors deriving from base codebooks multiplied by a gain, the base codebooks being explored one after the other, by subtracting the known contribution of the partial excitation produced by the vectors of the preceding codebooks. Thus, in this advantageous embodiment, the cascaded codebooks are explored one after the other, by subtracting, for a current codebook, a known contribution of a partial excitation produced by the vectors of at least one preceding codebook, which confers a hierarchical coding structure.

In a particularly advantageous way, the search in a codebook according to the invention for a best candidate excitation vector is performed according to an estimation of a CELP criterion, that is little changed from the prior art and then comprises the following steps:

a) calculating the convolution of the impulse response of a filter resulting from the product of an LPC synthesis filter by a perceptual filter, with the basic pattern of the codebook, to obtain a convoluted filter vector,
b) calculating the elements of an inter-correlation vector between a candidate target vector and the convoluted filter vector,
c) possibly correcting elements of the inter-correlation vector to take account of a truncation of the basic pattern at least one block edge,
d) calculating the elements of a self-correlation matrix of the convoluted filter vector,
e) possibly correcting elements of said matrix to take account of a truncation of the basic pattern at least one block edge,
f) performing a search for the best candidate vector using a CELP criterion expressed as a maximization of a ratio in which the numerator involves the elements of the inter-correlation vector and the denominator involves the elements of the self-correlation matrix.

It will be understood that, since the search can reveal basic patterns at the block edge, the estimation of the CELP criterion is slightly modified by the addition of the steps c) and e), compared to the estimation of the CELP criterion according to the prior art.

Moreover, simplifications to the optimum search algorithms of the base codebooks are also proposed when the relative energy of the parts to be truncated is low compared to those of the parts that remain in the block for the edge patterns. In this case, one of the steps c) and e), or both, can be omitted.

Other simplifications are also proposed, aiming to truncate the impulse responses of the synthesis filters multiplied by the perceptual filter, and to truncate the convoluted filter vector calculated in the step a).

The present invention targets not only the method defined hereinabove but also the codebook, itself, of CELP excitation vectors, that can be constructed by a digital audio signal coding/decoding device, by implementing the inventive method.

It also targets a computer program comprising instructions for implementing the method of constructing a codebook as defined hereinabove.

It also targets the digital audio signal coding/decoding device, comprising at least one codebook according to the invention. Typically, an advantageous embodiment consists in providing a device including means (such as a processor, a calculation memory, etc.) for generating the CELP excitation vectors of one or more codebooks, at least one of which is a codebook to be constructed by implementing the inventive method.

Advantageously, these codebooks can be constructed by executing a computer program of the above-mentioned type, then stored in a memory of such a coding/decoding device, for example by the use of an algebraic law associating the vector indices with the vector codes themselves (as, for example, in the ACELP technique).

The present invention also targets a use of such a device for coding/decoding digital audio signals (therefore typically a coding/decoding method), and the computer program intended for a digital audio signal coding/decoding device, and comprising instructions for implementing such a use.

Generally, all or some of the general and optional characteristics expressed hereinabove can be applied equally for the construction of the codebook, and for the codebook itself, or for the coding/coding device comprising at least one duly constructed codebook or for the use of such a device, or even for the computer program generating the codebook or for the computer program enabling the use of the device.

Thus, the invention proposes codebooks of CELP-type excitation vectors and their use, which offer a great potential richness of content for a moderate size. The decoding of the associated indices is not very complex, despite this variety of forms. It is also possible to put in place rapid algorithms for selecting the optimum vector, by exploiting the particular composition of these codebooks.

It will be remembered that the present invention proposes a category of CELP codebooks that allows for the encoding of a wide variety of excitation signals for relatively moderate bit rates, and also offering rapid and effective algorithms for selecting the appropriate vector.

Figure 5:
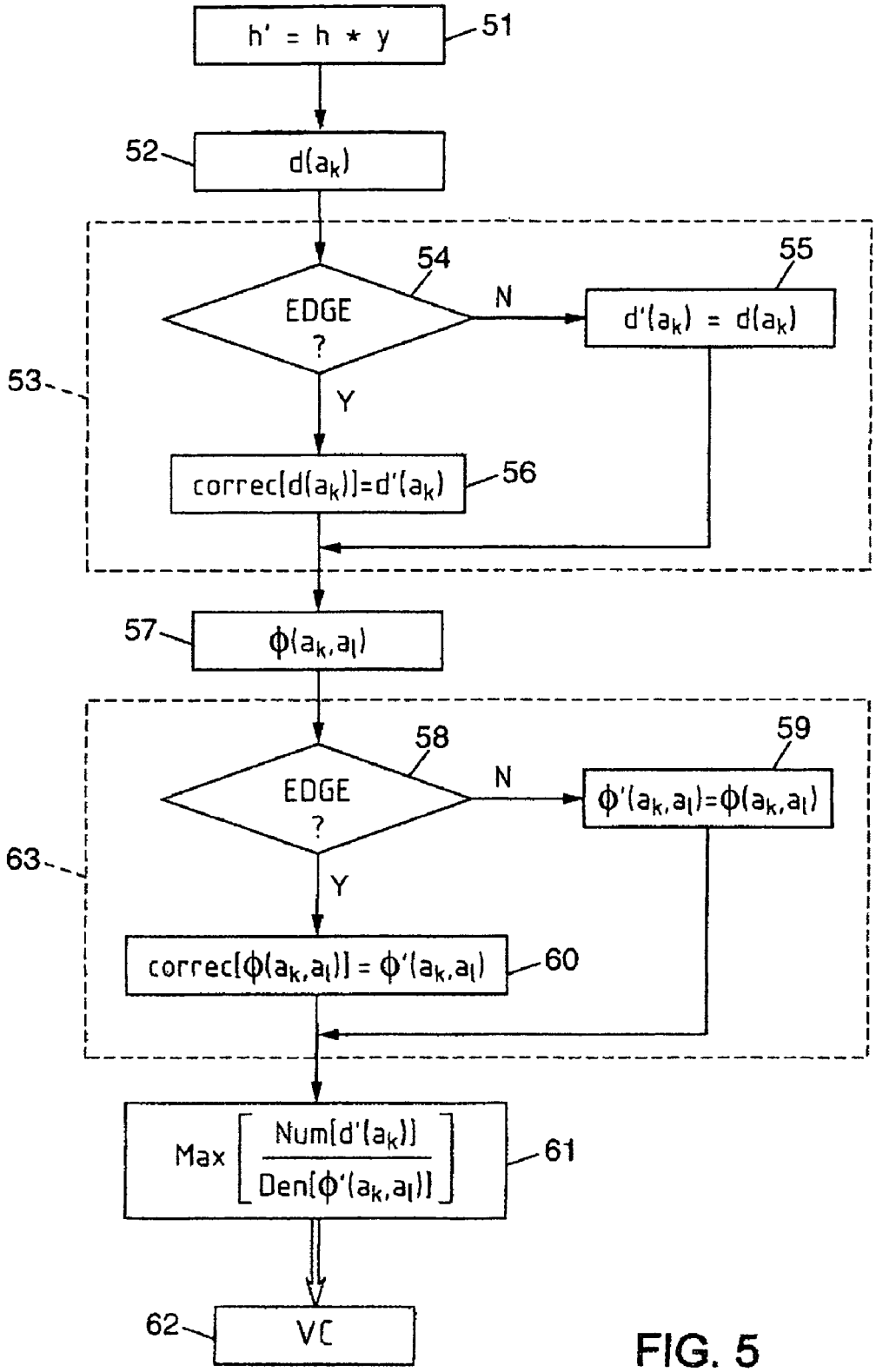
Figure 6:
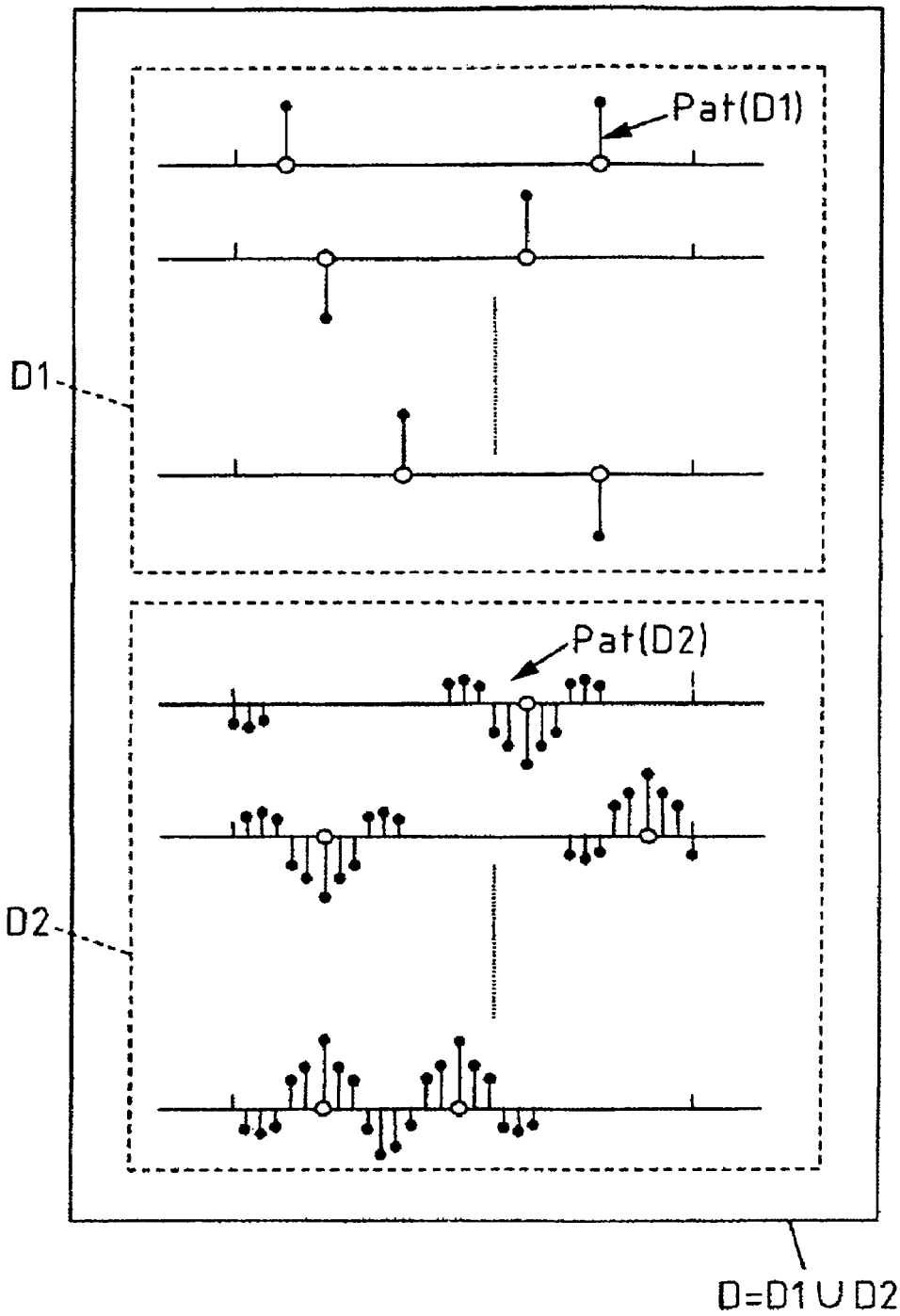
Figure 7:
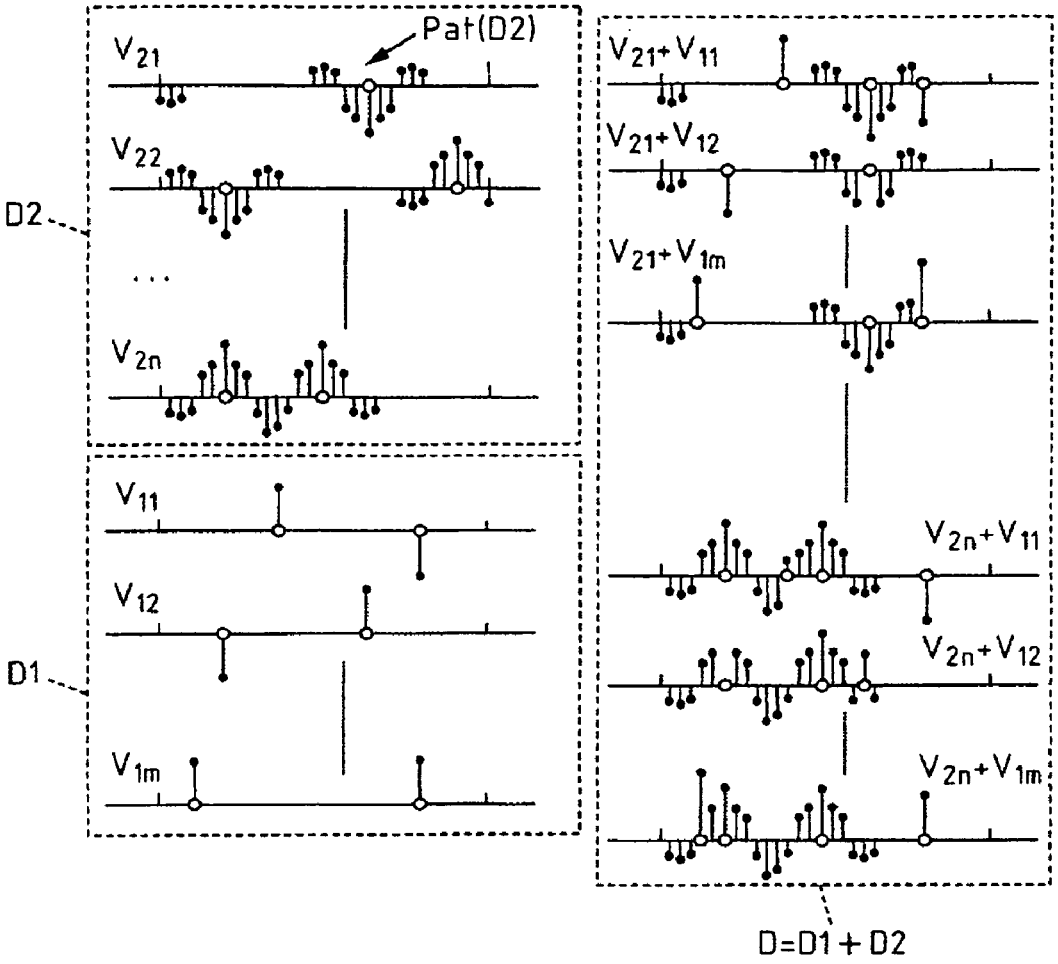
Figure 8A:
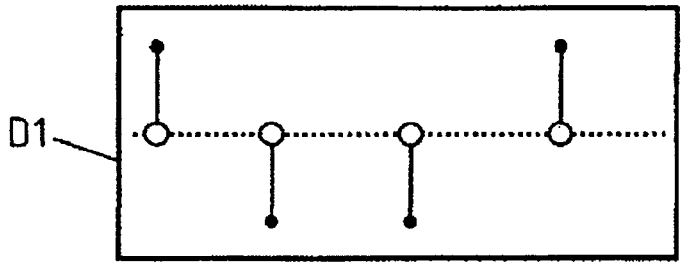
Figure 8B:
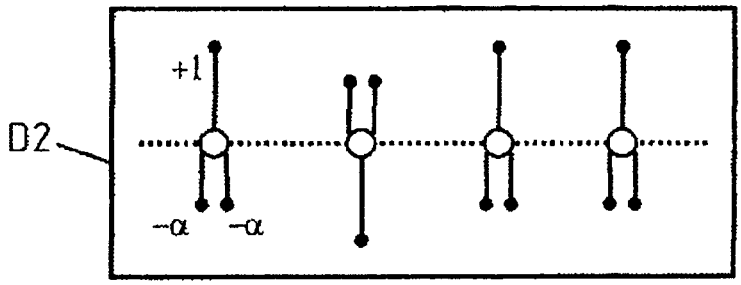
Figure 8C:
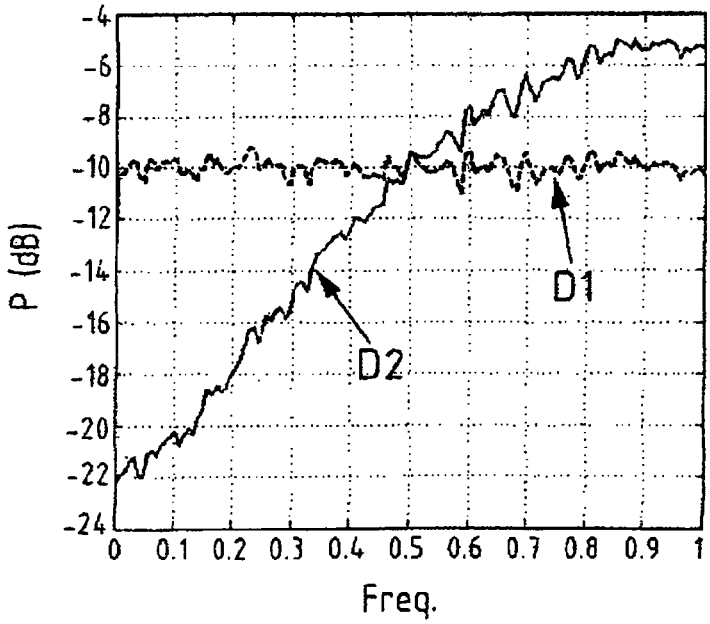
Figure 9:
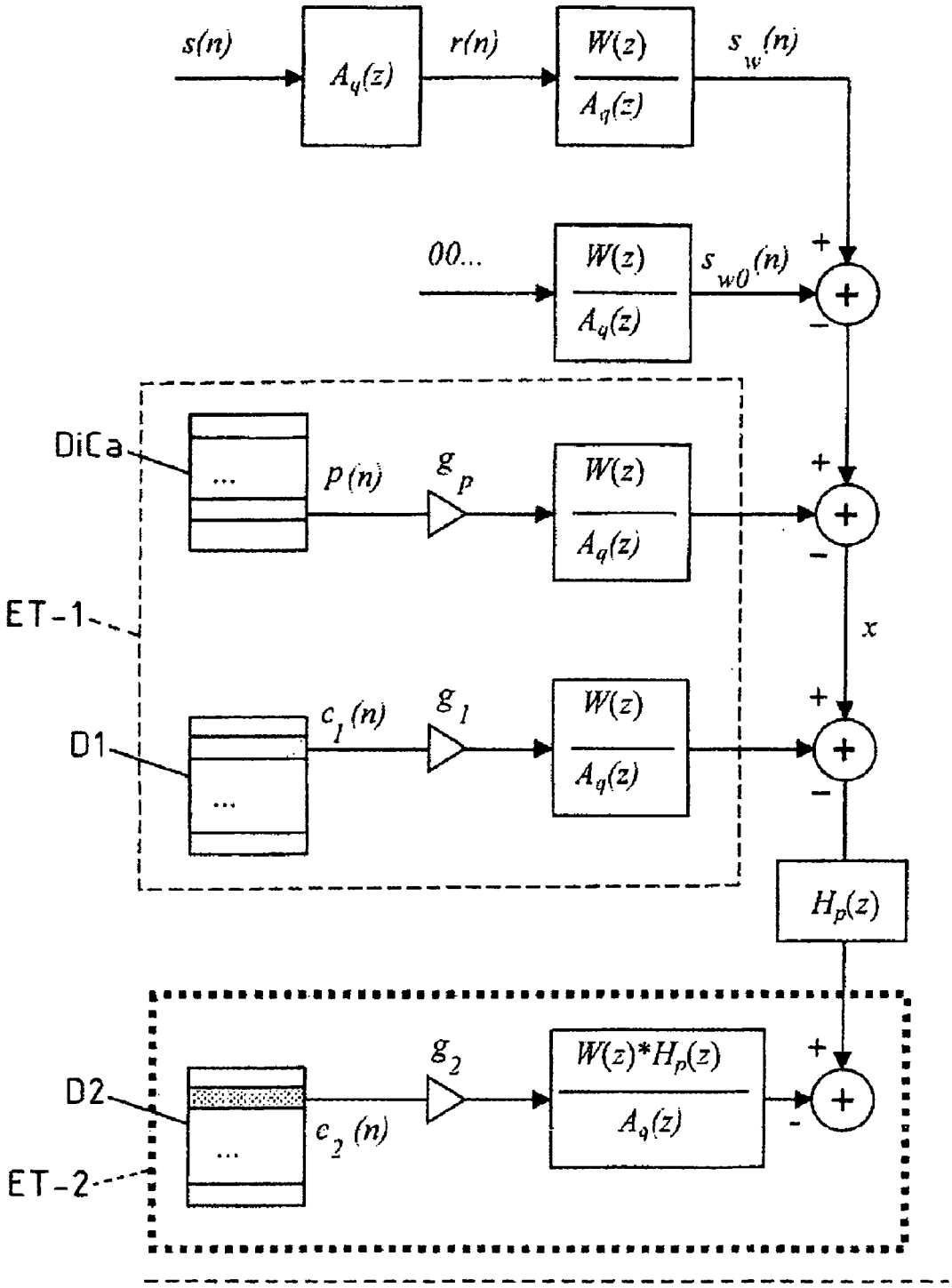

Other characteristics and advantages of the invention will become apparent from studying the detailed description below, and the appended drawings in which, besides FIGS. 1 and 2 described hereinabove:

FIG. 3*a* illustrates a basic pattern for the implementation of the invention, FIGS. 3*b* and 3*c* respectively illustrate a first $A_0$ and a second $A_1$ set of positions of the first and the second occurrences of a basic pattern, FIG. 3*d* illustrates an example of vector code selected by the implementation of the invention, FIG. 4 is a table of the modifications of the self-correlation matrix in the estimation of the CELP criterion using a codebook according to the invention, FIG. 5 illustrates the main steps for searching for the best vector code in a codebook according to the invention, by applying the "corrected" CELP criterion to take account of the presence of patterns of which a part is located outside of a current block, FIG. 6 illustrates an example of union of codebooks according to the invention, FIG. 7 illustrates an example of summation of codebooks according to the invention, FIGS. 8*a* and 8*b* illustrate a first and a second base codebook in an exemplary embodiment of the present invention to refine a CELP coder according to the G.729 standard, FIG. 8*c* compares the appearance of the mean spectra of the waveforms of the codebook of FIG. 8*a* and of the codebook of FIG. 8*b*, FIG. 9 illustrates an exemplary embodiment of a CELP coder according to the G.729 standard refined by an exemplary implementation of the present invention.

Referring firstly to FIGS. 3*a* to 3*d*, there follows a description of the content of a "basic" codebook according to the invention.

The vector codes of a base codebook are obtained by defining a basic pattern y(j) ($-p \leqq j \leqq p$) as a sequence of samples (FIG. 3*a*) which is shifted in a block of length N, by truncating the pattern when it overruns the block. K occurrences of this same pattern, multiplied by an amplitude factor, are added together to form the vector codes of the codebook.

As an example, the broken line box bearing the reference D2 in FIG. 7 illustrate a few vectors V21, V22, V2*n* of a base codebook constructed in this way. The first vector V21 comprises a basic pattern Pat(D2) comprising a succession of eleven pulses. To the left of this pattern, the "end" of a pattern of reverse polarity and truncated such that only its ninth to eleventh pulses appear in the V21 vector can be seen. The next vector V22 repeats the entire pattern Pat(D2) and another pattern truncated on the right and of the reverse polarity. In the vectors V21 and V22, the patterns are separate. On the other hand, in the last vector V2*n*, two basic patterns are repeated with the same polarity, but their respective centers occupy positions that are sufficiently close for the two patterns to partially overlap. In this case, the pulses that overlap are added together, taking into account their size. For example, the last vector V2*n* of the codebook D2 in the example of FIG. 7 comprises the sum of the pulses of the two basic patterns at their edges, right for one and left for the other (tenth and eleventh pulses of the global pattern from the left). Similarly, the (negative) pulse of the center of the second pattern of the vector V21 is cancelled with the second (positive) pulse of the vector V12 in the sum of the vectors V21+V12.

Thus, in more generic terms, out of the accepted positions for the basic patterns in each block of an excitation vector, pattern positions are such that patterns overlap at least partially (case of the vector V2*n*). In this case, the pulses of the patterns that overlap are added together.

It will be noted that the formulation given hereinabove: y(j) ($-p \leqq j \leqq p$), presenting the advantage of clarifying the subsequent developments, seems to impose a priori an odd number 2p+1 of elements in the basic pattern ($-p \leqq j \leqq p$). In fact, as mentioned previously, this particular feature is by no means necessary for implementing the present invention. If a pattern having an even number of elements is to be used, all that is required is to add a zero element to one of the edges, and the formulation applied here can still be used.

Each vector $\{c(n)\}$ of a base codebook, of dimension N, is constructed by adding K occurrence vectors $y^k$ such that: $Y^K=\{s_k \times y^k(n)\}$, for n ranging from 0 to N−1 and k ranging from 0 to K−1.

These vectors are made up of a basic pattern assigned a given amplitude, truncated if necessary at the edge or edges and complemented by zeroes.

Each occurrence k is characterized:

- by the amplitude assigned to it, $s_k$, taking its values from a set $s_k$,
- by the position of the basic pattern, which can be represented, for example, by the position $a_k$ at which its center is placed. $a_k$ takes its values from a set $A_k$, and can possibly be located outside the range [0, N−1], the only constraint being, of course, that the intersection of the patterns and of the block is not zero.

FIGS. 3*b* and 3*c* illustrate such a codebook for which in particular K=2. The first occurrence is characterized by the center $a_0$ which can be located at the five positions of a set of positions $$A_0 = \{a_0^1, a_0^2, a_0^3, a_0^4, a_0^5\}$$

and by the amplitude $s_0 \in S_0=\{\pm 1\}$ (FIG. 3*b*). The second occurrence is characterized by the center $a_1$ which can be located at the four positions of the set $$A_1 = \{a_1^1, a_1^2, a_1^3, a_1^4\}$$

and by the amplitude $s_1 \in S_1=\{\pm 1\}$ (FIG. 3*c*). The codebook then comprises:

5 (positions $A_0$)×4 (positions $A_1$)×2 (polarities for $A_0$)×2 (polarities for $A_1$)=80 vector codes.

An example of vector code for this codebook (defined by the positions $a_0=a_0^1$ and $a_1=a_1^3$ and by the amplitude $s_0=+1$ and $s_1=-1$) is given in FIG. 3*d*.

The following therefore applies:

$$y^k(n) = \begin{cases} y(j) & \sin = a_k + j; \\ & \mathrm{Max}(-p, -a_k) \le j \le \mathrm{Min}(p, N-1-a_k); \quad a_k \in A_k \\ 0 & \text{if } a_k \notin A_k \end{cases}$$

Which can also be expressed:

$$y^k(n) = \sum_{j=-p}^{p} y(j) \times \delta(n - a_k - j) \times t(n),$$

using the Kroenecker δ(.) and truncation t(n)=0 if n∉[0, N−1] functions.

Each vector $\{c(n)\}$ is defined by the set of the positions of the centers of the basic patterns of each of the occurrences of which it is composed $$(a_0, a_1, \ldots, a_{K-1}) \in \prod_{k=0}^{K-1} A_k,$$

where Π designates the Cartesian product of the sets, and by the set of the amplitudes $$(s_0, s_1, \ldots, s_{K-1}) \in \prod_{k=0}^{K-1} S_k$$

associated with the different occurrences.

The components c(n) (0≦n≦N−1) are obtained by summation of the (any) contributions of the K vectors $y^k$ to the sample n, according to the relation:

$$c(n) = \sum_{k=0}^{K-1} s_k \times y^k(n) = \sum_{k=0}^{K-1} s_k \times \sum_{j=-p}^{p} y(j) \times \delta(n - a_k - j) \times t(n);$$

$$0 \le n \le N-1$$

If the vectors $\{c_0(n)\}$ of dimension (N+2p) are defined such that:

$$c_0(n) = \sum_{k=0}^{K-1} s_k \times \delta(n - a_k),$$

with $$-p \le n \le N-1+p,$$

then $$c(n) = t(n) \times \sum_{j=-p}^{p} y(j) \times c_0(n-j)$$

The vectors $\{c(n)\}$ of the base codebook are deduced from the vectors $\{c_0(n)\}$ by convolution with the basic pattern y and truncation at the edges of the segment [0, N−1].

It can be seen that the vectors $\{c_0, (n)\}$ are defined by the data of the centers $$(a_0, a_1, \ldots, a_{K-1}) \in \prod_{k=0}^{K-1} A_k$$

of the basic patterns and that of the amplitudes $$(s_0, s_1, \ldots, s_{K-1}) \in \prod_{k=0}^{K-1} S_k.$$

If the centers are ordered structurally, it will be understood that it is possible to exploit this structure to define rapid algorithms in order to speed up the selection of the vector code in the codebook.

The truncation function t(n) introduces non-linearities into the expression of c(n), which can be dispensed with by extending the vector $\{c(n)\}$ of dimension N to the vector $\{c'(n)\}$ of dimension (N+2p):

$$c'(n) = \begin{cases} 0 & -p \le n < 0 \\ c(n) & 0 \le n < N \\ 0 & N \le n < N + p \end{cases}$$

It is therefore possible to reveal three parts in the vector {c'(n)}:

$$c'(n)=c_c(n)+c_g(n)+c_d(n);\ -p \leqq n \leqq N-1+p$$

The central part $$c_c(n) = \sum_{j=-p}^{p} y(j) \times c_0(n-j);$$

$$-p \le n \le N-1+p$$

corresponds to the convolution of $\{c_0(n)\}$ with the basic pattern and its components in the intervals of the edges, [−p, −1] and [N, N+p−1] are non-zero a priori.

The other two terms cancel any non-zero components of the edges of $c_c(n)$ and correspond to the effects induced by the possible truncation of the pattern at the edges:

with the effect of the left edge of the block:

$$c_g(n) = \begin{cases} -\sum_{j=-p}^{p} y(j) \times c_0(n-j) & \text{if } -p \le n < 0 \\ 0 & \text{if } 0 \le n \le N-1+p \end{cases}$$

and that of the right edge of the block:

$$c_d(n) = \begin{cases} 0 & \text{if } -p \le n \le N-1 \\ -\sum_{j=-p}^{p} y(j) \times c_0(n-j) & \text{if } N \le n \le N-1+p \end{cases}$$

There now follows a description of the search for a vector code in a base codebook.

It will be remembered that the CELP criterion to be maximized:

$$\frac{Num^2}{\text{Den}} = \frac{\left(\sum_{n=0}^{N-1} x(n)c^w(n)\right)^2}{\sum_{n=0}^{N-1} c^w(n)^2}$$

involves calculating two quantities: the numerator Num and the denominator Den.

The vector $\{c^w(n)\}$ of dimension (N+2p) is defined by the convolution of the vector {c'(n)} given hereinabove with the impulse response of the filter H(z). However, in the selection of the optimum waveform, only the N central elements of this vector are used.

$$c^w(n) = \sum_{i=-\infty}^{+\infty} h(i) \times c'(n-i)$$
$$= b_c(n) + b_g(n) + b_d(n),$$

with $$-p \le n \le N-1+p$$

In this expression, the central factor $$b_c(n) = \sum_{i=-\infty}^{+\infty} h(i) \times c_c(n-i)$$

is calculated by introducing the vector {h'(i)}, corresponding to the convolution of the impulse response of the filter H with the basic pattern (or $$h'(i) = \sum_{j=-p}^{p} h(i-j) \times y(j)).$$

The following is then obtained:

$$b_c n = \sum_{i=-\infty}^{+\infty} h(i) \times c_c(n-i)$$
$$= \sum_{i'=-\infty}^{+\infty} c_0(n-i') \times \sum_{j=-p}^{p} h(i'-j) \times y(j)$$

It will be remembered that the central factor is then expressed as follows:

$$b_c(n) = \sum_{i=-\infty}^{+\infty} h'(i) \times c_0(n-i)$$
$$= \sum_{k=0}^{K-1} s_k \times h'(n-a_k)$$

The "left edge" factor $$b_g(n) = \sum_{i=-\infty}^{+\infty} h(n-i) \times c_g(i),$$

or $$b_g(n) = -\sum_{j=-2p}^{p-1} \sum_{i=Max(-p+j,-p)}^{Min(-1,p+j)} c_0(j) \times h(n-i) \times y(i-j),$$

is also expressed:

$$b_g(n) = -\sum_{a_k \in \Gamma_g} s_k \times \sum_{i=Max(-p+a_k,-p)}^{Min(-1,a_k+p)} h(n-i) \times y(i-a_k),$$

by introducing the set $$\Gamma_g = \bigcup_{k=0}^{K-1} A_k \cap [-2p,\ p-1],$$

combining for the K sets $A_k$, $k \in [0, K-1]$, the positions $-2p \leqq a_k < p$.

The number of terms in the factor $b_g(n)$ depends on the definition domains $A_k$ of the centers $a_k$ of the basic pattern in the K occurrences. However, for the patterns to overlap the current block at least partially, it is important to avoid the center being too distant from the first sample of this block, by more than p samples. This condition is expressed $a_k \geqq -p$, which leads to:

$$\mathrm{Min}(-1,\ a_k + p) = -1,$$

and $$\Gamma_g = \bigcup_{k=0}^{K-1} A_k \cap [-p,\ p-1]$$

Therefore $$b_g(n) = -\sum_{a_k \in \Gamma_g} s_k \times \sum_{i=1}^{Min(p-a_k,p)} h(n+i) \times y(-i-a_k)$$

By defining the function $$h''(n,\ j) = \sum_{i=1}^{Min(p-j,p)} h(n+i) \times y(-i-j),$$

the "left edge" factor is then expressed $$b_g(n) = -\sum_{a_k \in \Gamma_g} s_k \times h''(n,\ a_k).$$

It will be noted that the latter expression involves, for each occurrence k, only the values $a_k$ of the centers which are in the range [−p, p−1].

The "right edge" factor is expressed at the outset $$b_d(n) = -\sum_{i=-\infty}^{+\infty} h(n-i) \times c_d(i)$$

and, to repeat the principles applied to the left edge hereinabove:

$$b_d(n) = -\sum_{j=N-p}^{N+2p-1} c_0(j) \times \sum_{i=Max(N,j-p)}^{Min(N+p-1,j+p)} h(n-i) \times y(i-j),$$

or $$b_d(n) = -\sum_{a_k \in \Gamma_d} s_k \times \sum_{i=Max(N,a_k-p)}^{Min(N+p-1,a_k+p)} h(n-i) \times y(i-a_k),$$

with $$\Gamma_d = \bigcup_{k=0}^{N-1} A_k \cap [N-p,\ N+2p-1]$$

In a symmetrical manner to the preceding case, the center of the pattern is at most p samples away from the right edge, which leads to $a_k \leqq N+p-1$, therefore:

$$\mathrm{Max}(N,\ a_k - p) = N \text{ and } \Gamma_d = \bigcup_{k=0}^{K-1} A_k \cap [N-p,\ N+p-1]$$

By defining a function $$h'''(n,\ j) = \sum_{i=N}^{Min(N+p-1,j+p)} h(n-i) \times y(i-j),$$

it is also possible to express:

$$b_d(n) = -\sum_{a_k \in \Gamma_d} s_k \times h'''(n,\ a_k)$$

The number of non-zero elements h'''(n,j) thus depends on the number of non-zero elements h(n) such that n<0. If it is assumed that the filter H(z) is causal, all the elements $b_d(n)$ such that $n \leqq N-1$ are zero.

Therefore, in the case of a causal filter in which h(n)=0 if n<0, the right edge effects have no impact on this calculation.

Hereinafter, it will be assumed that a pattern cannot be truncated on both sides at once. The contrary case would mean that a pattern can be of a size greater than the length N of the block, the invention nevertheless possibly being applied also to this latter case.

There now follows a description of the application of the CELP criterion with a codebook according to the invention.

The numerator can be calculated as follows:

$$\begin{aligned} Num &= \sum_{n=0}^{N-1} x(n) c^w(n) \\ &= \sum_{n=0}^{N-1} x(n) \times (b_c(n) + b_g(n) + b_d(n)) \\ &= \sum_{n=0}^{N-1} x(n) \times \left( \sum_{k=0}^{K-1} s_k \times h'(n-a_k) - \sum_{a_k \in \Gamma_g} s_k \times h''(n,\ a_k) - \right. \end{aligned}$$

-continued $$\left.\sum_{a_k \in \Gamma_d} s_k \times h'''(n, a_k)\right)$$

The "central" term $$\sum_{n=0}^{N-1} x(n) \times \sum_{k=0}^{K-1} s_k \times h'(n - a_k)$$

is similar to the usual expression of the numerator of the criterion for selecting the optimum waveform in a multi-pulse codebook. As in the conventional search, $$d(a_k) = \sum_{n=0}^{N-1} x(n) \times h'(n - a_k)$$

is defined and this "central" term then becomes $$\sum_{k=0}^{K-1} s_k \times d(a_k).$$

It is possible to obtain a similar expression for all the numerator of the codebook according to the invention by posing:

$$d'(a_k) = \begin{cases} d(a_k) - \sum_{n=0}^{N-1} x(n) \times h''(n, a_k)) & \text{if} \quad a_k \in \Gamma_g \\ d(a_k) - \sum_{n=0}^{N-1} x(n) \times h'''(n, a_k) & \text{if} \quad a_k \in \Gamma_d \\ d(a_k) & \text{if} \quad a_k \notin \Gamma_g \cup \Gamma_d \end{cases}$$

which amounts to adding a correction to the elements $d(a_k)$ for the centers $a_k$ that belong to the sets $\Gamma_g$ and $\Gamma_d$, that is corresponding to occurrences in which the pattern, placed at the edge, requires a truncation.

$$Num = \sum_{k=0}^{K-1} s_k \times d'(a_k),$$

then applies, which is similar to the numerator of the search for the best waveform of a conventional multi-pulse type codebook.

The denominator is calculated as follows:

$$Den = \sum_{n=0}^{N-1} (c^w(n))^2$$

with $$c^w(n)^2 = \left[\sum_{k=0}^{K-1} s_k \times h'(n - a_k)\right]^2 + \left[\sum_{a_k \in \Gamma_g} s_k \times h''(n, a_k)\right]^2 +$$

-continued $$\left[\sum_{a_k \in \Gamma_d} s_k \times h'''(n, a_k)\right]^2 - 2\left[\sum_{k=0}^{K-1} s_k \times h'(n - a_k)\right]\left[\sum_{a_l \in \Gamma_g} s_l \times h''(n, a_l)\right] -$$

$$2\left[\sum_{k=0}^{K-1} s_k \times h'(n - a_k)\right]\left[\sum_{a_l \in \Gamma_d} s_l \times h'''(n, a_l)\right] +$$

$$2\left[\sum_{a_k \in \Gamma_g} s_k \times h''(n, a_k)\right]\left[\sum_{a_l \in \Gamma_d} s_l \times h'''(n, a_l)\right]$$

The "central" term is conventionally expressed by:

$$\sum_{n=0}^{N-1}\left[\sum_{k=0}^{N-1} s_k \times h'(n - a_k)\right]^2 =$$

$$\sum_{k=0}^{K-1} s_k^2 \times \phi(a_k, a_k) + 2 \times \sum_{k=0}^{K-2}\sum_{l=1}^{K-1} s_k \times s_l \times \phi(a_k, a_l).$$

$$\phi(i, j) = \sum_{n=0}^{N-1} h'(n - i) \times h'(n - j)$$

is an element of the self-correlation matrix of the vector $\{h'(n)\}$. For the search for the optimum waveform, only the elements of the self-correlation matrix involving the positions of the centers of the pattern in the different occurrences are used.

The latter expression is again similar to that of the denominator in the case of a conventional multi-pulse codebook.

On the other hand, for all the denominator estimated in the CELP criterion with a codebook according to the invention, a self-correlation function is introduced that is modified in the way presented in the table of FIG. 4. By taking account of this modification of the self-correlation function, it is possible to obtain an expression that is identical to the case of a conventional multi-pulse codebook.

The modified matrix thus makes it possible to express the denominator of the search in the codebook according to the invention in the form:

$$Den = \sum_{k=0}^{K-1} s_k^2 \times \phi'(a_k, a_k) + 2 \times \sum_{k=0}^{K-2}\sum_{l=k+1}^{K-1} s_k \times s_l \times \phi'(a_k, a_l)$$

which is identical to that of the denominator for the search in a conventional multi-pulse codebook.

There now follows a description of the search proper in the codebook according to the invention.

Referring to FIG. 5, the following steps are preferably provided.

The convolution vector of the impulse response of the filter H is calculated (step 51) with the basic pattern:

$$h'(i) = \sum_{j=-p}^{p} h(i - j) \times y(j).$$

The elements $$d(a_k) = \sum_{n=0}^{N-1} x(n) \times h'(n - a_k),$$

of the correlation vector between the target vector x(n) and the vector {h'(i)} (obtained in the step 51) are then calculated (step 52).

These elements (general step 53 of FIG. 5) are then corrected if necessary for the patterns appearing at the block edge. In practise, for values of $k \in \{0, 1 \ldots, K-1\}$ such that the centers $a_k \in A_k$ of the patterns impose a truncation of the patterns at the edges of a block (Y arrow at the output of the test 54), corrected elements $d'(a_k)$ are calculated (step 56). Otherwise (N arrow at the output of the test 54), $d'(a_k)=d(a_k)$ is imposed (step 55). In both cases, a vector $\{d'(a_k)\}$ is obtained that advantageously takes account of the edge effects, at the end of the step 53.

The elements of the self-correlation matrix of {h'(i)} are then calculated (step 57) for the determination of the denominator:

$$\phi(a_k, a_k) = \sum_{n=0}^{N-1} h'(n - a_k)^2,\ a_k \in A_k;\ 0 \to K-1,$$

and $$\phi(a_k, a_l) = \sum_{n=0}^{N-1} h'(n - a_k) \times h'(n - a_l)$$

with $$a_k \in A_k,\ a_l \in A_l,\ k = 0 \to K-1,\ l = k+1 \to K-1.$$

These elements (general step 63 of FIG. 5) are corrected if necessary to again take account of the patterns appearing at the block edge. In practise, for all the pairs $(a_k,a_l)$ of which at least one of the elements corresponds to the occurrence of a pattern that overruns one of the block edges (Y arrow at the output of the test 58), in the step 60, corrected elements $\Phi'(a_k,a_l)$ are calculated. Otherwise (no pattern at the block edge, which corresponds to the N arrow at the output of the test 58), $\Phi'(a_k,a_l)=\Phi(a_k,a_l)$ is imposed in the step 59. In both cases, matrix elements are obtained that advantageously take account of the edge effects, at the end of the general step 63.

The search for the best waveform is then performed (step 61) using the conventional CELP search criterion, expressed as the maximization of a ratio in which the numerator implements the vector $\{d'(a_k)\}$ and the denominator the elements $\Phi'(a_k,a_l)$, to ultimately obtain the best vector code VC (step 62).

It should be indicated here that FIG. 5 can illustrate, in flow diagram form, a part of the algorithm of the computer program that makes it possible to use a coding/decoding device comprising at least one codebook according to the invention.

The search for the waveform in a base codebook according to the invention ultimately boils down to that, which is known and effective, of the search in a conventional multi-pulse codebook. In particular, if the positions of the centers $a_k \in A_k$ of the occurrences k (ranging from 0 to K−1) of the patterns describe the positions of the pulses of ACELP-type structured codebooks, it will be possible to use the effective rapid algorithms developed for such ACELP codebooks.

It has been assumed that the pattern is of a size less than that of the block. However, in the contrary case, all that is needed is to introduce a zone $\Gamma_g \cap \Gamma_d$ in which the two corrections are applied, with no loss of generality of the method.

Simplifications of the above method can also be provided. For example, when the relative energy of the elements that are supplanted in the truncation operation is low compared to the energy of the elements that remain in the block, for the occurrences at the edges, it may be possible to provide simply for disregarding the edge effects (without then conducting the tests 54 and 58). In this case, at least one (preferably the step 63) or both of the correction steps 53 and 63 can be simply eliminated.

There now follows a description of a few possible compositions of the base codebooks.

Two combination methods can be provided to offer a global codebook capable of providing varied representations of the waveforms, in particular to offer a very satisfactory spectral richness. In practise, it is possible to direct the content of each base codebook to one or several signal categories.

Union of Base Codebooks

The union of base codebooks makes it possible to provide a single codebook, each part of which corresponds to a base codebook. For a signal portion that will be better represented by one of the base codebooks, the best waveform can then be found in this base codebook to represent this signal portion.

FIG. 6 illustrates such a codebook, presenting the union of two base codebooks D1 and D2, constructed from the same sets of positions for the centers of the occurrences and the same sets of amplitudes, and each with two patterns respectively comprising:

a single pulse Pat(D1) for the first base codebook D1, and the sequence of pulses Pat(D2) according to the pattern of FIG. 3*a* for the second base codebook D2.

For a given excitation vector to be coded, each of the base codebooks is preferably explored separately, the best waveforms deriving from the search in each base codebook then being compared to each other to select the most appropriate of them. The complexity of the search is in this case equivalent to the sum of the complexities of the searches in each base codebook. The rapid searches, induced by the advantageous structure of the base codebooks as seen previously, have proven very effective.

Exploration variants can also be proposed. For example, it is possible to determine firstly one (or several) base codebooks out of the codebooks that make up the global codebook, then to limit the search to the duly preselected base codebooks.

The decoding of the indices can be conducted by first identifying the base codebook that has been selected (for example by comparing the index of the selected vector code to values stored in memory corresponding to the boundaries of the base codebooks in the complete codebook). Then, the index of the vector code is decoded in the base codebook in the way indicated previously.

Sum of Base Codebooks

This implementation is advantageous. The object is to construct and use codebooks adding the vectors of the base codebooks to exploit characteristics specific to its component base codebooks, but also to exploit their combined characteristics.

Thus, in the case of a sum of codebooks, the vectors of the codebooks are simply formed by adding, one by one and sample by sample, all the vectors of the base codebooks, possibly weighted by gains as in the second embodiment described below.

In practise, two embodiments are proposed hereinbelow for taking the sum of several codebooks.

In a first embodiment, the global codebook D=D1+D2 is obtained by adding together the waveforms deriving from each base codebook. FIG. 7 illustrates the principle of such an addition of base codebooks. In the example represented, only two codebooks D1, D2 are added together and it will be seen that the weightings of the pulses of the vectors V1*i* of the codebook D1 are the same, in the sum D1+D2, as those of the pulses of the vectors V2*j* of the codebook D2.

Then, here, a single gain associated with a given sum is defined. Thus, there is still the benefit of the advantage relating to the simplicity of the decoding using codebooks, at least one of which is a base codebook. In practise, a vector code belonging to a base codebook D2 can be represented by indicating the positions at the centers of the patterns and the amplitudes of the occurrences in the different codebooks, that is, for the different patterns, and by then adding together the scaled then duly placed patterns.

The components of the vector codes of such a codebook, obtained by the summation of I base codebooks, is expressed by a relation of the type:

$$c(n) = \sum_{i=0}^{I-1} c_i(n),$$

and the current excitation vector is expressed:

$$exc_{current}(n) = g \times \sum_{i=0}^{I-1} c_i(n) \text{ if } 0 \le n \le N-1.$$

It can also be advantageous to adapt the rapid algorithms proposed in the context of a single base codebook to the sum of codebooks described hereinabove. As an illustrative example, consider the sum of two base codebooks, which is expressed:

$$c(n) = c_1(n) + c_2(n) = \sum_{k=0}^{K_1-1} s_k \times y_1^k(n) + \sum_{l=0}^{K_2-1} s_l \times y_2^l(n),$$

where the indices 1 and 2 relate respectively to the vectors deriving from the first pattern $\gamma_1$ and the second pattern $\gamma_2$, encountered in $K_1$ and respectively $K_2$ occurrences.

As in the case of a single base codebook described previously, it is possible to define vectors $\{h_1'(i)\}$, $\{h_1''(i, a_k); a_k \in \Gamma_g^1\}$, $\{h_1'''(i, a_k); a_k \in \Gamma_d^1\}$ corresponding to the first pattern and vectors $\{h_2'(i)\}$, $\{h_2''(i, a_k); a_k \in \Gamma_g^2\}$, $\{h_2'''(i, a_k); a_k \in \Gamma_d^2\}$ corresponding to the second pattern. The conventional expressions of the numerators and denominators of the searches in multi-pulse codebooks again apply, provided that the expressions of the correlation vectors are adapted as follows.

For the intercorrelation with the target vector, it is possible to calculate modified vectors $\{d'_1(a_k)\}$ and $\{d'_2(a_k)\}$ as proposed above and the numerator is then expressed:

$$Num = \sum_{k=0}^{K_1-1} s_k \times d_1'(a_k) + \sum_{i=0}^{K_2-1} s_l \times d_2'(a_l).$$

The case of the denominator is, however, more complicated because, in addition to the self-correlations $$\phi_1'(a_k, a_l);\ a_k \in A_k^1,\ a_l \in A_l^1 \text{ and } \phi_2'(a_k, a_l);\ a_k \in A_k^2,\ a_l \in A_l^2$$

defined above, the correlations between the occurrences of the first pattern and those of the second pattern have to be involved. Thus, for example, for center values $a_k^1 \in A_k^1$ such that $a_k^1 \notin \Gamma_g^1 \cup \Gamma_d^1$ and $a_1^2 \in A_1^2$ such that $a_1^2 \notin \Gamma_g^2 \cup \Gamma_d^2$, with k<1, the following must be calculated:

$$\phi'(a_k^1, a_l^2) = \sum_{n=0}^{N-1} h_1'(n - a_k^1) \times h_2'(n - a_l^2).$$

These expressions become fairly complicated in the general case, even though they remain within the scope of those skilled in the art.

The denominator can still be expressed according to a relation of the type:

$$Den = \sum_k S_k^2 \times \phi'(a_k, a_k) + 2 \times \sum_{k,l} \sum_{k<l} s_k \times s_l \times \phi'(a_k, a_l)$$

in such a way that it is still possible to calculate the elements of a modified self-correlation matrix and, here again, the accelerated search algorithms of the multi-pulse codes can be used.

A second embodiment of a sum of base codebooks gives rise to simpler search algorithms. The principle consists of cascading the summation of the base codebooks, a different gain being associated with each subvector deriving from the base codebooks. In this case, the excitation vector is expressed by:

$$exc_{current}(n) = \sum_{i=0}^{I-1} g_i \times c_i(n) \text{ if } 0 \le n \le N-1.$$

This variant is very advantageous in terms of complexity.

It presents even more advantages. Since each base codebook is more particularly intended to enrich the global codebook and, for example according to a particular type of excitation signals, it can be advantageous to use different perceptual filters $W_i(z)$ (for i ranging from 0 to I−1) for the different searches in the base codebooks. For example, it is possible to use a first base codebook more suitable for representing the low frequency part of the excitation signal, and a second base codebook intended more to represent the high frequency part. It will then be particularly advantageous is such a scheme to favor the high frequency part of the spectrum in the search in the second base codebook. For example, in the second search, the conventional perceptual filter can be cascaded with a high-pass filter. Such an operation could moreover be qualified as "spectral focusing". It will be described in detail later, with reference to FIG. 9, to illustrate a particular exemplary embodiment.

Finally, this second embodiment is advantageously suited to hierarchical CELP coding structures. In practise, in these structures, the bitstream is hierarchically organized and, in the implementation of this second embodiment, the bits corresponding to the indices and to the gains of each of the sub-vector codes of the base codebooks can form separate hierarchical layers (or "participate" in separate layers). If the decoder receives only a part of this information, it can reconstruct at least a part of the excitation by decoding the received indices and gains associated with the sub-vector codes of the base codebooks of the first layers and by adding together the partial excitations obtained in this way.

As indicated above the first base codebook then handles the minimum quality coding and the subsequent ones provide a progressive increase in quality and the better inclusion of the possible variety of the signals, for example by offering a broad spectral content.

There now follows a description of an embodiment of the invention applied to an existing coder/decoder.

The exemplary embodiment described hereinbelow is located in the context of a hierarchical CELP coder producing a bitstream comprising two layers, a first layer of which corresponds to the "core" coding of the hierarchical structure, which operates at the bit rate of 8 Kbit/s and a second layer provides a quality enhancement for four additional Kbit/s, which produces a total bit rate of 12 Kbit/s. The bitstream of the first layer is "compatible" with that of the ITU-T G.729 standardized coder so that a coder or respectively a decoder according to the invention can operate with a decoder or respectively a coder conforming to the G.729 standard and its appendices for the bit rate of 8 Kbit/s.

In the proposed exemplary embodiment, the hierarchy is provided by the use of a codebook according to the variant of cascaded summation of the base codebooks according to the invention. The block size is 5 ms, or 40 samples at 8 kHz.

The first base codebook D1 (FIG. 8*a*) is of "trivial" type and corresponds simply to the ACELP codebook of the G.729 coder, the vectors of which are obtained by adding together four signed pulses, the positions of which belong to sets indicated in the table 2 given below. For more details, reference can usefully be made to the ITU-T Recommendation G.729 ("Coding of Speech at 8 Kbit/s using Conjugate Structure Algebraic Code Excited Linear Prediction (CS-ACELP)", March 1996).

It is therefore a base codebook associated with a pattern restricted to the central pulse (p=0), with K=4 occurrences, the sets $S_0$, $S_1$, $S_2$, $S_3$ being given in the second column of table 2, and the sets $A_0$, $A_1$, $A_2$, $A_3$ in the last column.

TABLE 2

ACELP codebook for the G.729 coder

| Pulse | Sign | Positions |
|---|---|---|
| $i_0$ | $S_0$: ±1 | $A_0$: 0, 5, 10, 15, 20, 25, 30, 35 |
| $i_1$ | $S_1$: ±1 | $A_1$: 1, 6, 11, 16, 21, 26, 31, 36 |
| $i_2$ | $S_2$: ±1 | $A_2$: 2, 7, 12, 17, 22, 27, 32, 37 |
| $i_3$ | $S_3$: ±1 | $A_3$: 3, 8, 13, 18, 23, 28, 33, 38 |
| | | 4, 9, 14, 24, 29, 34, 39 |

The second base codebook D2 (FIG. 8*b*) is a non-trivial codebook, the basic pattern (or "tri-pulses") of which, of length three, comprises three pulses of respective amplitudes $-\alpha$, +1 and $-\alpha$, preferably with $0<\alpha\leqq 0.35$. The value $\alpha$ can advantageously be chosen dynamically according to the characteristics of the input signal.

The number of occurrences, the amplitudes and the positions of the centers of the pattern are identical to those of the first codebook.

FIG. 8*c* shows the appearance of the mean spectra of the waveforms of the first codebook (arrow D1) and of the second codebook (arrow D2). It can be seen that the first codebook presents a spectrally flat content whereas the second codebook is richer in high frequencies.

This observation makes it possible to enhance the quality obtained by the first coding layer, which provides a good quality playback for the speech signals in the low-frequency part of the zone [300-3400 Hz], and tends to decrease in energy and in fidelity on approaching the high frequencies.

To better focus the search in the second base codebook on the high frequencies of the spectrum, when exploring this second codebook, a supplementary high-pass filter $H_p(z)$ is applied to the filter W(z).

FIG. 9 illustrates a coder according to this embodiment. A first stage ET-1 introduces the adaptive codebook DICa (vector $\{p(n)\}$ and its associated gain $g_p$, then the first fixed codebook D1 (vector $\{c_1(n)\}$) and the associated gain $g_1$. A second stage ET-2 presents the search in the second fixed codebook D2 (vector $\{c_2(n)\}$) and the associated gain $g_2$. The searches in the adaptive codebook DICa and the first fixed codebook D1 use the perceptual filter $W_1(z)=W(z)$, such as that defined, for example, in the G.729 standard. The second codebook D2 uses a search focused in the high frequencies by the addition of the filter $H_p(z)$: $W_2(z)=W(Z)\times H_p(z)$ The search in the first base codebook D1 is known and uses, for example, one or other of the rapid and focused algorithms described in the G.729 standard and its reduced complexity appendix A (ITU-T Recommendation G.729, "Annex A: Reduced complexity 8 Kbit/s CS-ACELP speech codec", November 1996).

The search in the second base codebook D2 also exploits this rapid algorithm, as described above.

In the interests of legibility hereinbelow, all the indices "2" relating to the second codebook will be omitted in the following (for example $H_2(z)$ becomes H(z), $c_2^w(n)$ becomes $c^w(n)$, and so on).

According to a first simplification, the impulse response of the filter $$H(z) = \frac{W(z) \times H_p(z)}{A_q(z)}$$

is truncated to the elements h(n) such that $0\leqq n\leqq 39$ (recalling that the length of the blocks N=40).

The vector $\{c^w(n)\}$ is therefore defined for $-1\leqq n\leqq 40$. As mentioned above, the right edge is not involved ($b_d(n)=0$) because of the fact that h(n)=0 for n<0 (causal filter).

It will also be seen that the positions of the centers $a_k$ are all in the block [0,39].

In these conditions, the set $$\Gamma g = \bigcup_{k=0}^{3} Ak \cap [-1, 0]$$

comprises only a single element, namely the position $a_0=0$, in the set $A_0$ only and corresponding to the first position of the tri-pulse pattern on the first occurrence: $\Gamma_g=\{0\}$.

FIG. 9 will then diagrammatically represent a device according to the invention, in particular, in this case, a coding device.

As mentioned previously, the convolution vector of the impulse response of the filter H with the basic pattern is calculated first (first step referenced 51 in FIG. 5), which gives:

$$h'(n)=-\alpha h(n+1)+h(n)-\alpha h(n-1)$$

Since h(n) is zero for n≦0 or n≧40, h'(n) is however non-zero a priori for −1≦n≦40.

To calculate the numerator $$Num = \sum_{k=0}^{3} s_k \times d'(a_k)$$

of the CELP criterion, the intercorrelation $$d(a_k) = \sum_{n=0}^{39} x(n) \times h'(n - a_k)$$

it is first calculated (step 52), modified (general step 53) to:

$$d'(a_k) = \begin{cases} d(a_k) - \sum_{n=0}^{39} x(n) \times h''(n, a_k) & \text{if } a_K = 0 \text{ (step 56 of figure 5)} \\ d(a_k) & \text{if } a_K = 0 \text{ (step 55 of figure 5)} \end{cases}$$

The correction to be made is therefore limited to correcting the first element:

$$d'(0) = d(0) - \sum_{n=0}^{39} x(n) \times h''(n, 0)$$

with $$h''(n, 0) = -\alpha \times h(n+1).$$

The sets $A_k$ cover all the positions of the block [0,39]. It is therefore necessary to calculate d'(j) for any of 0≦j≦39, with the relation:

$$d'(0) = \sum_{n=0}^{39} x(n) \times h'(n) + \alpha \sum_{n=0}^{39} x(n) \times h(n+1)$$

and $$d'(j) = d(j) = \sum_{n=j-1}^{39} x(n) \times h'(n - j) \text{ if } 1 \le j \le 39$$

For the denominator, the self-correlations must be calculated (step 57):

$$\phi(a_k, a_k) = \sum_{n=0}^{39} h'(n - a_k)^2, k = 0 \to 39$$

and

-continued $$\phi(a_k, a_l) = \sum_{n=0}^{39} h'(n - a_k) \times h'(n - a_l), k = 0 \to 38, l = k + 1 \to 39.$$

(It will be recalled that the notation k=x→y actually means: "for k ranging from x to y").

The constraint h'(n)=0 for n<−1 leads to $$\phi(i, j) = \sum_{n=Max(j-1,0)}^{39} h'(n - i) \times h'(n - j)$$

for any pair of elements (i,j) with i<j, bearing in mind that Φ(i,j)=Φ(j,i).

The correction (step 60) to be made to the elements $\Phi'(a_k, a_l)$ to take account of the left edge is as follows:

$$\phi'(0, 0) = \phi(0, 0) + \alpha^2 \times \sum_{n=0}^{38} h(n+1)^2 + 2\alpha \sum_{n=0}^{38} h'(n) \times h(n+1)$$

$$\phi'(0, a_l) = \phi(0, a_l) + \alpha \sum_{n=a_l-1}^{38} h(n+1) \times h'(n - a_l); 1 \le a_l \le 39$$

It is therefore ultimately not necessary to calculate h'(40), only the elements h'(n), with −1≦n≦39, involved in the calculation. It will be recalled that the other elements $\Phi(a_k,a_k)$, with $a_k \neq 0$, and $\Phi(a_k,a_l)$ with $a_k \neq 0$, $a_1 \neq 0$, do not have to be corrected and $\Phi'(a_k,a_l)=\Phi(a_k,a_l)$ is set in this case (step 59 of FIG. 5).

Additional simplifications can also be provided, in particular for a small coefficient α. In practise, for the calculation of the denominator, if the elements are expressed h'(n)=−αh(n−1)+h(n)−αh(n+1), it is possible to show the self-correlation function:

$$\Phi_0(i, j) = \sum_{n=Max(i,j)}^{N-1} h(n - i) \times h(n - j)$$

i,j=0−>N−1 of the filter H(z).

A decision can then be taken to disregard all the terms involving elements of this matrix when they are multiplied by $\alpha^2$.

Furthermore, there is no need to take account of the edge effects in the calculation of the denominator, given that they are little involved in the sum $$\sum_{n=0}^{39} (c^w(n))^2,$$

bearing in mind that p=1 and α is substantially less than 1.

Consequently, the edge effects can be disregarded both on the numerator and on the denominator.

Finally, it is possible to introduce to an additional simplification that makes it possible to calculate the elements of the self-correlation matrix of the second base codebook in exactly the same way as that of the first. This simplification involves truncating {h'(n)} in the range [0,39]. The error produced in this way depends on the value of α but also on the gradient of the spectrum. Typically, for a signal with a strong energy concentration in the low frequencies, the value of h(0) is of the same order as that of the adjacent elements and it will be understood that h'(−1)=−α×h(0) that has little influence on the calculation.

Of course, the present invention is not limited to the embodiment described hereinabove by way of example; it extends to other variants.

Generally, the codebooks defined by the implementation of the invention offer a wide flexibility of use. Since each block is totally independent of those that precede it or follow it, it is possible to use for one block a codebook that is totally different from that used for the adjacent blocks with no particular precautions. Any problems of continuity are thus avoided. It is then very easy to adapt the codebooks used to the signal to be coded, for example by modifying the pattern or patterns used for the base codebooks. Provision can also be made to modify the sets that define the positions of the centers of the patterns in the occurrences and/or the sets of amplitudes. These possible modifications are, for example, particularly suited to the case of source-governed variable bit rate coders.

The invention claimed is:

1. A method of constructing a codebook of CELP-type excitation vectors for coding/decoding digital audio signals, each vector of dimension N comprising pulses that can occupy N valid positions, wherein an initial codebook is constructed by:

providing a common sequence of pulses forming a basic pattern; and assigning the basic pattern to each excitation vector of the codebook, based on one or more occurrences at one or more respective positions out of said N valid positions, and wherein the basic pattern comprises three pulses:

a central pulse, a second pulse preceding the central pulse, and a third pulse succeeding the central pulse, wherein:

the signs of the second and third pulses being opposite to that of the central pulse, and the amplitude of the second and third pulses being less, as an absolute value, than that of the central pulse.

2. The method as claimed in claim 1, wherein the basic pattern appearing on each occurrence in an excitation vector is multiplied by an amplitude associated with said occurrence.

3. The method as claimed in claim 1, wherein:

all the vectors of the initial codebook comprise one and the same number of occurrences of said pattern; and the initial codebook is defined by:

the sequence of pulses forming the basic pattern, the number of occurrences of the pattern in each vector, sets of positions allowed for the occurrences of said patterns, and sets of amplitudes to be associated with the occurrences of said patterns.

4. The method as claimed in claim 1, wherein the patterns appearing at the block edge of a vector are truncated and the remaining pulses of the truncated patterns occupy the start or the end of the block.

5. The method as claimed in claim 1 wherein, among the positions accepted for the patterns in each block of a vector, the pattern positions are such that the patterns overlap at least partially, and in that the pulses of the patterns that overlap are added one to one.

6. The method as claimed in claim 1 wherein, a global codebook is constructed by a summation of base codebooks, at least one of which is an initial codebook defined by a basic pattern, and in that the vectors of the global codebook are formed by adding the common position pulses of the vectors of the base codebooks, and wherein the vectors of the base codebooks are weighted by a gain, each associated with a codebook, to construct said sum.

7. A non-transitory computer readable medium having stored thereon a computer program comprising instructions for implementing the method of constructing a codebook, as claimed in one of claims 1, 2, 3, 4, 5, or 6.

8. A codebook of CELP-type excitation vectors, for coding/decoding digital audio signals, comprising excitation vectors of dimension N comprising a common sequence of pulses, forming a basic pattern, based on one or more occurrences at one or more respective positions out of N valid positions, and wherein the basic pattern comprises three pulses:

a central pulse, a second pulse preceding the central pulse, and a third pulse succeeding the central pulse, wherein:

the signs of the second and third pulses being opposite to that of the central pulse, and the amplitude of the second and third pulses being less, as an absolute value, than that of the central pulse.

9. Device for coding/decoding digital audio signals, comprising at least one codebook as claimed in claim 8.

10. The device as claimed in claim 9, comprising a plurality of cascaded codebooks including at least one initial codebook obtained by implementing the method as claimed in one of claims 1, 2, 3, 4, 5, or 6, and comprising an initial codebook and a subsequent codebook in said cascade of codebooks.

11. The device as claimed in claim 10, wherein the positions of the patterns and/or of the pulses in the vectors of said cascaded codebooks describe identical sets, the position of a pattern being substantially identified by the position of a central pulse in the sequence of pulses forming the pattern.

12. The use of the device as claimed in claim 9 for coding/decoding digital audio signals, wherein, in the coding, after determination of a best candidate vector in the initial codebook, an index is formed comprising at least indications:

of the position or positions of the basic pattern in the best candidate vector, and of the amplitude or amplitudes associated with the position or positions of the pattern, said index being intended to be transmitted for a subsequent decoding, and wherein in the decoding the best potential candidate is reconstructed from the index:

by positioning the basic pattern at the positions indicated by the index by multiplying the pattern at each position by an associated amplitude, and by adding the multiplied patterns positioned at said indicated positions.

13. The use as claimed in claim 12, wherein the device comprises a cascading of a plurality of codebooks which amounts to constructing a single global codebook obtained by summation of gain-weighted codebooks, and wherein the cascaded codebooks are explored one after the other, by subtracting, for a current codebook, a known contribution of a partial excitation produced by the vectors of at least one preceding codebook, which confers a hierarchical coding structure.

14. The use as claimed in claim 12, wherein said search is conducted in a codebook including vectors comprising patterns appearing at the block edge of a vector and benign truncated, the remaining pulses of the truncated patterns occupying the start of the end of the block, and to take account of a truncation of the basic pattern of at least one block edge, elements of the inter-correlation vector and/or elements of said matrix are corrected, as necessary.

* * * * *